United States Patent [19]

Edelson

[11] Patent Number: 4,704,605

[45] Date of Patent: Nov. 3, 1987

[54] METHOD AND APPARATUS FOR PROVIDING ANTI-ALIASED EDGES IN PIXEL-MAPPED COMPUTER GRAPHICS

[76] Inventor: Steven D. Edelson, 7 Sears Rd., Wayland, Mass. 01778

[21] Appl. No.: 682,141

[22] Filed: Dec. 17, 1984

[51] Int. Cl.[4] ..... G09G 1/16

[52] U.S. Cl. ..... 340/728; 340/703

[58] Field of Search ..... 340/728, 744, 747, 748, 340/750, 703

[56] References Cited

U.S. PATENT DOCUMENTS

| | | | |
|---|---|---|---|
| 3,486,037 | 4/1986 | Rosener et al. | 340/728 |
| 4,149,184 | 4/1979 | Giddings et al. | 358/81 |
| 4,237,457 | 12/1980 | Houldsworth | 340/728 |
| 4,242,678 | 12/1980 | Somerville | 340/728 |
| 4,262,290 | 4/1981 | Vallins | 340/728 |
| 4,371,872 | 2/1983 | Rossman | 340/728 |
| 4,386,349 | 5/1983 | Granberg et al. | 340/723 |
| 4,439,760 | 3/1984 | Fleming | 340/703 X |
| 4,447,809 | 5/1984 | Kodama et al. | 340/703 X |
| 4,454,593 | 6/1984 | Fleming et al. | 364/900 |
| 4,482,893 | 11/1984 | Edelson | 340/728 X |
| 4,486,785 | 12/1984 | Lasher et al. | 340/728 |
| 4,532,503 | 7/1985 | Pennebaker | 340/728 |
| 4,574,277 | 3/1986 | Klause et al. | 340/703 |
| 4,591,844 | 5/1986 | Hickin et al. | 340/728 |

*Primary Examiner*—Gerald L. Brigance

*Attorney, Agent, or Firm*—Lane and Aitken

[57] ABSTRACT

Smoothing information consisting of a mix value which indicates what percentage of the new color is to be displayed in a given pixel is stored in a pixel-plane memory. The value for the percentage for the old color is derived by subtracting the indicated percentage from 100%. Three methods for encoding the mix value for a pixel are disclosed.

The first method allocates specific bits for color and mix values. The second method encodes either mixing or color values in each pixel word. The subsequent pixel word is checked before deciding the proper treatment of a given pixel. The third method encodes either a color value or multiple mix values in each pixel word. The mix information is then displayed as a set of subpixels.

17 Claims, 17 Drawing Figures

METHOD AND APPARATUS FOR PROVIDING ANTI-ALIASED EDGES IN PIXEL-MAPPED COMPUTER GRAPHICS

FIELD OF THE INVENTION

The invention relates to image processing apparatus and methods for improving the appearance of a displayed image. More particularly, the present invention relates to scan line processing to reduce the "staircase" image artifact, a type of aliasing produced by sampling constraints affecting image scanning and recording.

BACKGROUND OF THE INVENTION

In common commercial practice today, a computer graphics screen is treated as if it were composed of rectilinear rows and columns of square picture elements referred to as "pixels", as is shown in FIG. 1. The image to be displayed on a computer graphics screen is stored as a series of sets of numbers or "words" where each such word corresponds 1-for-1 with the brightness and color of one pixel on the display screen. Since one memory unit is "mapped" onto one dot on the display screen, this is called, a "bit-mapped" or "memory-mapped" display.

This bit-mapping practice works well for straight, vertical or horizontal edges, but it is problematical for any other edges. One example of the problem is diagrammed in FIG. 2. Pixels labelled A through K represent a portion of one scan line on a display screen. The edge of an object intersects the scan line between pixels C and G. The object body lies below the bold line, in the cross-hatched area. This is referred to as a "leading" edge and the edge shown in FIG. 3 is referred to as a "trailing" edge because a CRT beam commonly produces these pixels while moving left-to-right. Thus, the left edge of an object is the first edge of the object that is displayed and the right edge is the second or "trailing" edge of the object.

Current systems encode such edges in various ways. The simplest ignore partial pixel coverage and arbitrarily treat some partially-covered border pixels as object pixels and others as background pixels. Everything to the left of the border pixel is unaffected by the object; the border pixel and all pixels to the right (until the trailing edge) are changed to the object color. The border pixel is arbitrarily selected as the leftmost affected pixel, C, or the rightmost affected pixel G, or the first pixel to be more than 50% covered, E. Any of these criteria can be used if the criterion is applied consistently to the whole screen. The problem with such encoding is that it produces the jagged stair-stepped edges prevalent in computer-graphics today. Its advantage is simplicity: the small amount of memory capacity required per pixel and the speed of the drawing algorithms using such encoding.

More sophisticated encoding used in several new commercial products defines several mixed color values, typically 16 such color values, that are shadings between the available object colors and a given background color. With an eight bit word allotted for each pixel, such a system can provide 15 object colors. Each of these colors would have 15 internally-defined additional colors that are intermediate shades between the object colors and a background color. For instance, if the object was blue and the background was black, the display system would produce one of 15 internally defined shades between blue and the given background color, black, required to simulate a pixel 15/16 covered with blue or 14/16 covered with blue, or 13/16 covered with blue . . . or 1/16 covered with blue.

An algorithm drawing the leading edge in FIG. 2 would assign to pixels C through G the closest of the 15 available "fractional" color value codes. Pixel C, being 1/10th covered by blue, would be rendered with the 2/16th blue color. Likewise pixel D is 3/10th covered and would be rendered using the 5/16th blue color. This results in an image which appears quite well "anti-aliased" in typical, medium resolution applications that is, the jagged stair-steps are smoothed.

The disadvantage of this system is the fact that the anti-aliasing is only possible between the given object colors and one designated background color. If one object color crosses in front of another object color, the edge again appears jagged since no intermediate shades are defined for this combination of colors—the only fractional colors defined are for objects displayed against a background. On the other hand, defining intermediate shades for each possible overlap of 16 object colors would produce $15 \times 120 = 1800$ color values, and require a larger memory for storing three more bits for exch pixel. When the look-up table, which converts the color value codes actual red, green, and blue intensity values must be revised to alter a particular color, 256 derivative intermediate shades affected by that color must be located, computed, and then replaced. Updating this table quickly is often desirable for simulating animation but would be difficult at best where edges are encoded in this way.

Another solution to the problem is to explicitly define the edge parameters. In FIGS. 2 and 3, a five-step transition would be used, each step increasing 20% of the color difference between the background color and the object color. This is an extremely powerful technique which yields images which are visually perfect within the capabilities of a CRT display screen, but it has two disadvantages: (1) It is incompatible with the pixel-based graphics software and stored bit-map graphics, such as land-sat photo. (2) The hardware to implement a full transition drawing system is too large and too expensive for consumer applications.

SUMMARY OF THE INVENTION

It is an object of the present invention to retain the quality of the transition drawing system in a bit-mapped display suitable for consumer use. It is also an object of this invention to use standard bit-map memory hardware and software.

It is an object of this invention to smooth edges between any one object color and any other object color. It is a further object of this invention to treat data which does not contain smoothing information in the same manner as it would be treated by a conventional non-smoothed pixel system, that is, to display images produced using older or simpler software which does not calculate smoothing information as having the same non-smoothed edges that they had when they were designed.

Apparatus for processing the pixel values of an image having "n" pixels in accordance with the present invention comprises image storage means having "n" storage locations, each of said storage locations containing image information for a respective single pixel of said "n" pixels, and mix encoding means, said mix encoding means providing a mix value which is a function of the area covered by the object within the pixel to the image storage means for each pixel containing an object edge, said mix value being stored in a storage location corresponding to said pixel containing the object edge.

BRIEF DESCRIPTION OF THE DRAWINGS

The invention and its advantages will be more clearly understood when the detailed description given below is considered in conjunction with the figures provided herewith wherein.

DETAILED DESCRIPTION OF THE PREFERRED EMBODIMENTS

Figure 1:
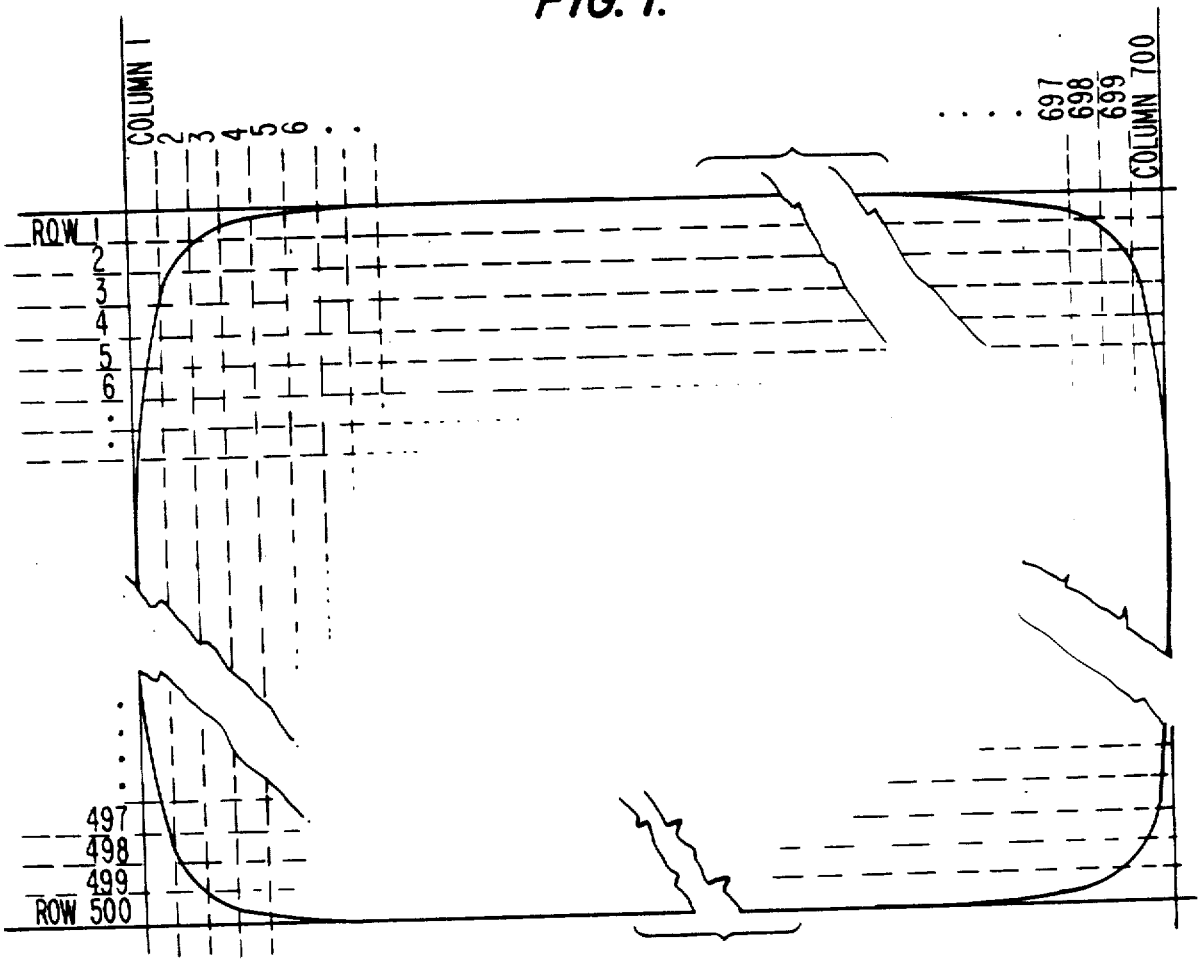
FIG. 1 shows a pixel-mapped screen.

In accordance with the present invention, a color value—or some other display information value—and a mix value which indicates what percentage of a pixel is covered by a given color value are both encoded for each pixel in which a color change occurs. The mix value is stored in a pixel word corresponding to the given pixel and interpreted in relation to a color value determined by the pixel word corresponding to the preceding pixel in a scan line. For example, in row 1 of the screen shown in FIG. 1, a mix value in the pixel word for the pixel in column 2 would be interpreted in relation to a color value for the pixel in column 1; the mix value for the pixel in column 3, in relation to a color value for the pixel in column 2; etc.

A Bit-Divide Embodiment

The simplest implementation of edge smoothing in accordance with the present invention divides a memory word allocated for each pixel into two areas, one area for color information, one area for mixing information. The mixing value area is preferably at least 4 bits long; thus, if out of the 8 bits allocated for each pixel 4 bits are allocated for color, the pixel word defines 16 colors and 16 "mixes" providing intermediate shades. The 16 color values can be hard-wired so that, for example, "3" is alway pure blue, etc., or they can be indexed in the "third" location of look-up table in RAM memory, which allows the software to determine colors dynamically. Each 8 bit entry for an "edge" pixel contains both the "new" color in the pixel, and the mix percentage calculated as a proportion of the old color present in the pixel. With 4 bits, numbers from 0 to 15, can be specified and these are interpreted to mean 0/16th to 15/16 contribution by the old color. For example, the mix value "3" indicates that the desired color mix is 3/16 old color and 13/16 new color. The notation I:J indicates an entry indicating color "I" and mix value "J", hence 3:6 is to be read as color #3 mixed as at 6/16 old color and 10/16 new color.

A "new" color becomes the "old" color when a different "new" color value appears in the data stream. If the color value in the pixel word is the same as the "new" color value, no updating of the "old" color value is performed. If this were not true, successive identical color pixels in a row would result in "old" and "new" colors being the same color. This defeats the goal of providing color mixing at edges, as is illustrated in the examples which follow.

TABLE 1

| | Bit-Divide/Leading Edge | | | | | | | | |
|---|---|---|---|---|---|---|---|---|---|
| Pixel | A | B | C | D | E | F | G | H | I |
| Before Image | 0:0 | 0:0 | 0:0 | 0:0 | 0:0 | 0:0 | 0:0 | 0:0 | 0:0 |
| After Image | 0:0 | 0:0 | 1:14 | 1:11 | 1:7 | 1:4 | 1:2 | 1:0 | 1:0 |

Figure 2:
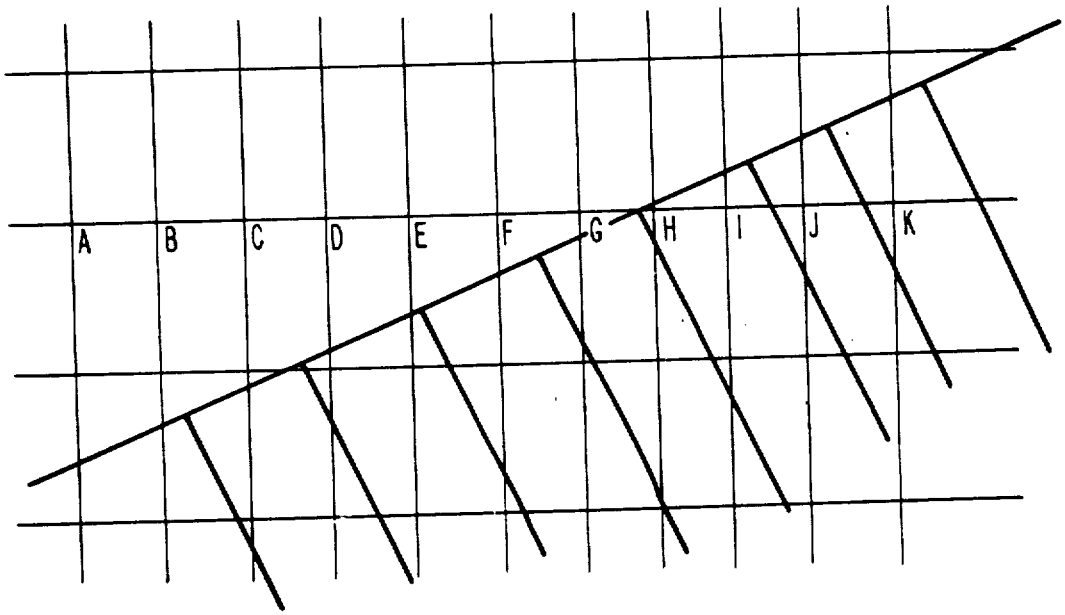
FIG. 2 shows a leading edge on a pixel-mapped screen.

Referring to the leading edge shown in FIG. 2, and the bit-divide pixel words in Table 1, the effect of an edge on a series of pixel words is illustrated. In these examples, all the pixels A through K have a color value of "0" and a mix value of "0", indicating that color #0 should be displayed without regard to an "old" color appearing in every location when the display screen is clear, before an image is input. When an image is input, the edge of an object having the color value of "1" affects pixel C, and pixel C is the first pixel in the row which changes. The new value of C, 1:14, indicates that the new color is color #1 and mixing should occur at a ratio of 14/16 of the "old" color #0 and 2/16 of the new color #1. This makes sense intuitively since pixel C is covered 90% by the old color and 10% by the new color. The new pixel affected is pixel "D". Here the entry is 1:11. Once again, the new color is #1. Since the color in pixel "C" was also #1, the "old" color does not change; it remains "0". Thus the mixing value of "11" indicates that the pixel is 11/16 the color #0 and 5/16 color #1. Again, inspection of pixel D shows that this represents the visual effect of the edge at pixel D. In this example #0 is, in effect, a background color but this mixing can occur between any two colors regardless of whether they are object or background colors.

Clearly, the "old" color does not change with every pixel word. Had it been updated at D, both the "old" and "new" colors would have a value of "1" and the proper mix to color #0 could not have been indicated. The "old" color must only change when the "new" color changes.

In FIG. 2, pixels E through G are calculated in the same manner as C and D. Pixel H is the first pixel which is completely within the object. Pixel H thus has a mixing value of "0". This is the mixing value which is inserted into pixel words for all the pixels which are completely in the interior of this given object within the image.

TABLE 2

| | Bit-Divide - Trailing Edge Image | | | | | | | | | | |
|---|---|---|---|---|---|---|---|---|---|---|---|
| Pixel | L | M | N | O | P | Q | R | S | T | U | V |
| Before Image | 0:0 | 0:0 | 0:0 | 0:0 | 0:0 | 0:0 | 0:0 | 0:0 | 0:0 | 0:0 | 0:0 |
| After Image | 1:0 | 1:0 | 1:0 | 1:0 | 1:0 | 0:14 | 0:9 | 0:5 | 0:2 | 0:0 | 0:0 |

Figure 3:
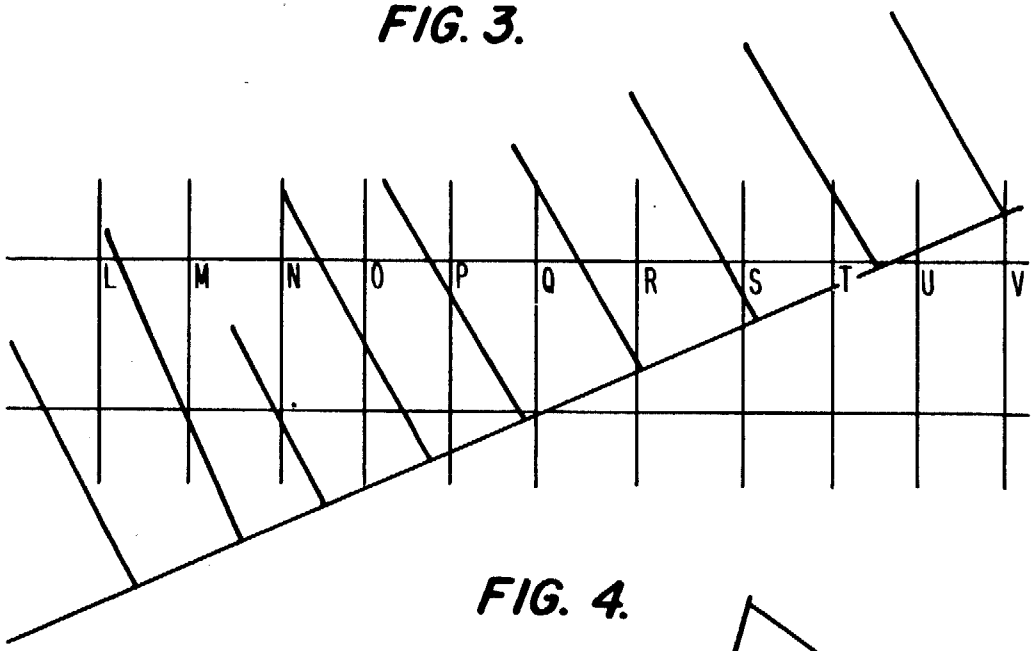
FIG. 3 shows a trailing edge on a pixel-mapped screen.

On the other side of the object is its trailing edge. The value for the pixels at the edge in FIG. 3 are listed in Table 2. The pixels are originally set to be 0:0—a blank screen. When the trailing edge of the object is input pixels L through P take on the value 1:0 because they lie entirely within the object. Pixels Q through T indicate a mix between the "old" color and the "new" color in various proportions.

TABLE 3

| | Bit-Divide - Steep Leading Edge Image | | | | | | | |
|---|---|---|---|---|---|---|---|---|
| Pixel | AA | BB | CC | DD | EE | FF | GG | HH |
| Before Image | 0:0 | 0:0 | 0:0 | 0:0 | 0:0 | 0:0 | 0:0 | 0:0 |
| After Image | 0:0 | 0:0 | 1:9 | 1:0 | 0:0 | 0:0 | 1:6 | 1:0 |

Figure 5:
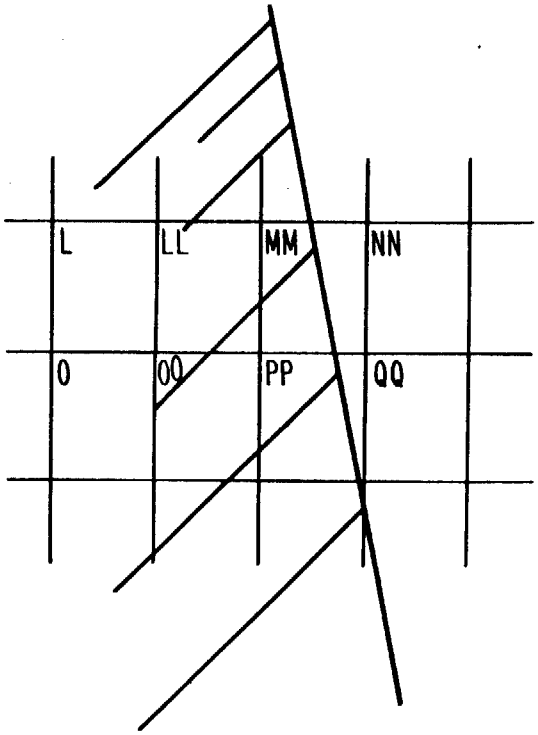
FIG. 5 shows a steep trailing edge on a pixel-mapped screen.
Figure 4:
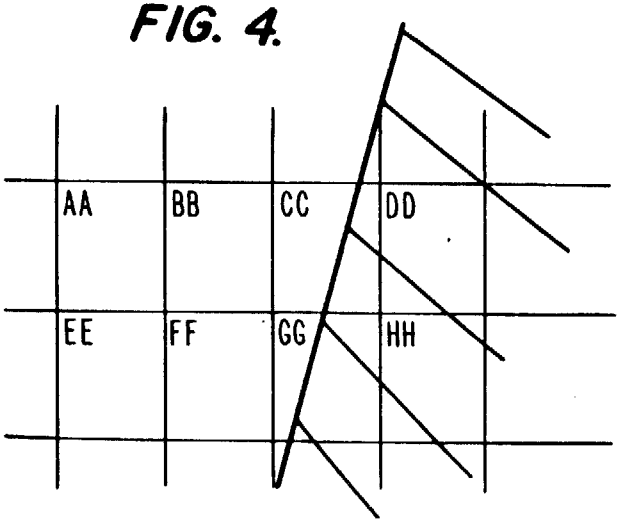
FIG. 4 shows a steep leading edge on a pixel-mapped screen.

This anti-aliasing performs well along edges which are close to horizontal, as shown in FIGS. 2 and 3. It is also effective in straightening the appearance of edges which are almost vertical as is illustrated in FIGS. 4 and 5. In Table 3, corresponding to FIG. 4, we again see the pixel values before and after the insertion of the leading edge of the object. We follow pixels AA through DD on one scan line, and pixels EE through HH on the adjacent scan line. Pixels AA, BB, EE, and FF are unaffected by the object and retain their value of 0:0. Pixels DD and HH lie entirely within the object and take on the value 1:0. The pixels which are cut by the edge, again take on the color of the object with the mixing value indicated by the percentage of their area covered by the old color. Thus CC becomes 1:9 and HH becomes 1:6. FIG. 5 and Table 4 show the equivalent calculation for a steep trailing edge:

TABLE 4

| | Bit-Divide - Steep Trailing Edge Image | | | | | |
|---|---|---|---|---|---|---|
| Pixel | LL | MM | NN | OO | PP | QQ |
| Before Image | 0:0 | 0:0 | 0:0 | 0:0 | 0:0 | 0:0 |
| After Image | 1:0 | 0:9 | 0:0 | 1:0 | 0:13 | 0:0 |

In computer graphics applications, such as CAD/-CAM or animation applications, the percentage of the area covered in a border pixel is produced as a by-product of the drawing process. When drawing the edge, the computer is typically moving up the edge, adding a small increment to the horizontal position of the edge on the previous scan line to calculate the horizontal position of the edge on the new scan line. This calculation must be carried out to a fractional part of a pixel to avoid rounding errors in subsequent position calculations. Thus the internal result of the computer arrives as is in the form: "Pixel numbers=32.54". Since the display did not have fractional pixels, the computer would traditionally decide to use pixel #33, but retain "32.54" as the edge location value for further calculations.

With the ability to mix, the result "32.54" can be interpreted as "pixel #33 should be shaded with 54% old color and 46% new color." This mixing, when done in the proportions indicated by the fractional position calculation has the fortuitous optical illusion of appearing to be an edge at the fractional position—just the desired effect. Applying this logic to nearly horizontal edges leads to the same value as the fractional position calculation.

If the color bits for each pixel in non-smoothed images are placed in the lower bits of the pixel's "word" in memory and the number of colors is suitably restricted, then these images drawn by older, non-smoothing software will be software compatible with bit-divide decoding apparatus. For example, if the display data for a non-smoothed image can be encoded in pixel words 8 bits long, and the non-smoothed image never uses a color value greater than "16", the upper 4 bits will consistently be "0", indicating "no mixing". Since the image was not drawn using edge-smoothing this is exactly the result that was intended. Such software will coincidently be indicating "no mix" to the anti-aliasing software. This will produce the conventional, jagged pixel graphics originally seen by the author of the image.

Figure 6:
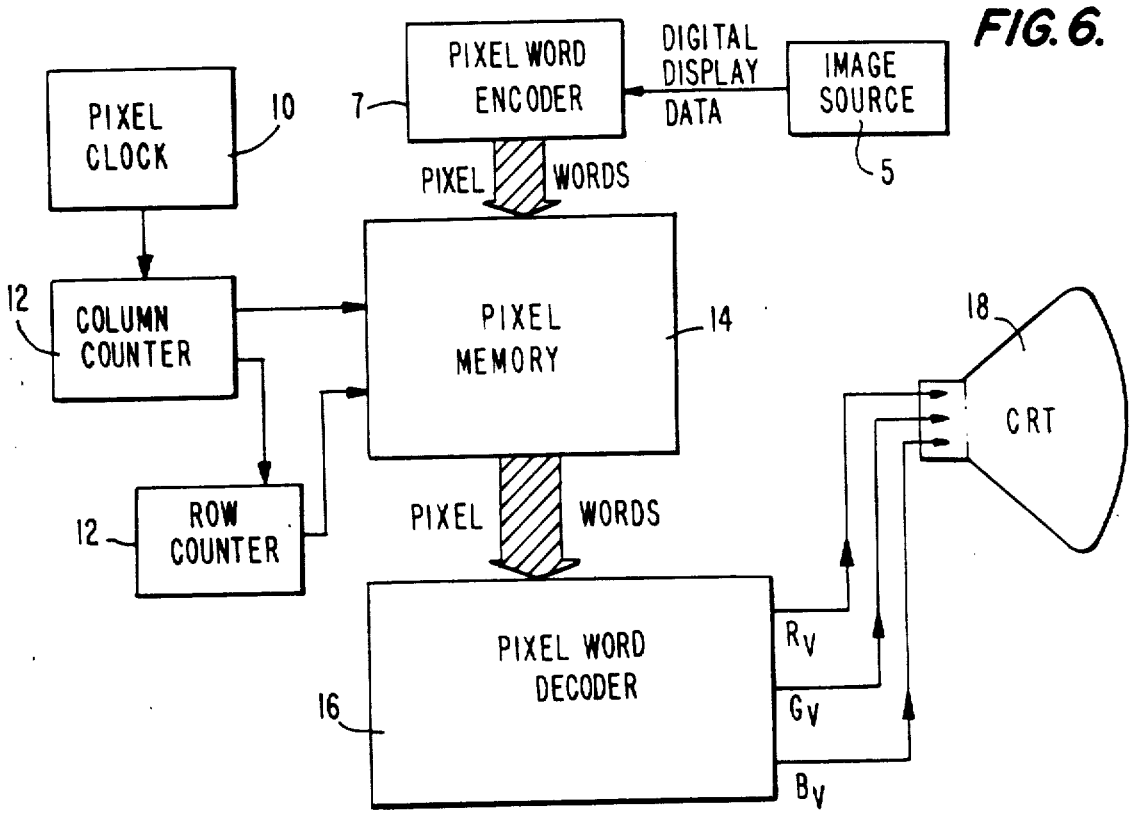
FIG. 6 shows a block diagram of anti-aliasing apparatus in accordance with the present invention.

FIG. 6 shows anti-aliasing apparatus in accordance with the present invention, wherein digital display data provided by CAD/CAM or video equipment, or some other image source is encoded into pixel words by image processing apparatus and stored in a pixel memory 14. The pixel words are read out of pixel memory 14 in response to pulses from a clock 10 that drives a pair of counters 12 which count the columns across the screen, and the rows down the screen. The column count and the row count generate pixel addresses which cause the corresponding data to be read from the pixel memory 14. This data is then decoded by video signal generator apparatus 16 to produce color signals R, G, B for input to the display CRT 18 in a suitable manner.

The digital display data from the image source 5 comprises both color and edge information, for example, the pixel colors and pixel fractions described above or an analog video signal that has been processed by a suitable A/D converter and a suitable drawing program that indicates the fractional position of the edges of the video image within respective pixels.

The video signal actually used for color displays typically comprises intensity information for each of three video primary colors and is further complicated by scan-line interlace which displays all even lines first and then all odd lines, the common practices of buffering of information for several pixels for simultaneous reading or recording to reduce memory access time, and the insertion or stripping of horizontal and vertical synchronization signals and brightness information required by CRT display devices. None of these complications are discussed here. They are well understood in the art, are common to virtually all pixel-based systems, and are available in off-the-shelf video controller IC's from major semiconductor vendors such as Texas Instruments and Motorola.

Means for converting video or computer graphics information to a pixel-mapped format suitable for storage in a pixel-mapped memory are well-known in the art. This converted information is then encoded with reference to corresponding pixel-fraction edge placement information such as the fractional pixel information illustrated above for CAD/CAM applications, and stored in pixel words in the pixel memory 14. The structure of preferred embodiments of the apparatus in accordance with the present invention is described below with particular reference to the decoding of pixel words stored in the pixel memory 14 such that the aliasing of edges occurring in given pixels is reduced, but it will be readily understood by one skilled in the art that the encoding of the color and edge placement information into these pixel words can be accomplished using either a general-purpose computer apparatus having image encoding software, or its hardwired equivalent, as is well-known in the art.

In the preferred embodiments described below the pixel values arrive from the pixel memory 14 serially, one pixel word at a time, at the input port to the video signal generator 16 shown in FIG. 7 in synchrony with the pixel clock 10. It is assumed that the pixel words are transferred from the pixel memory 14 on the rising edge of the clock and arrive after a finite but insignificant propagation delay.

Figure 7:
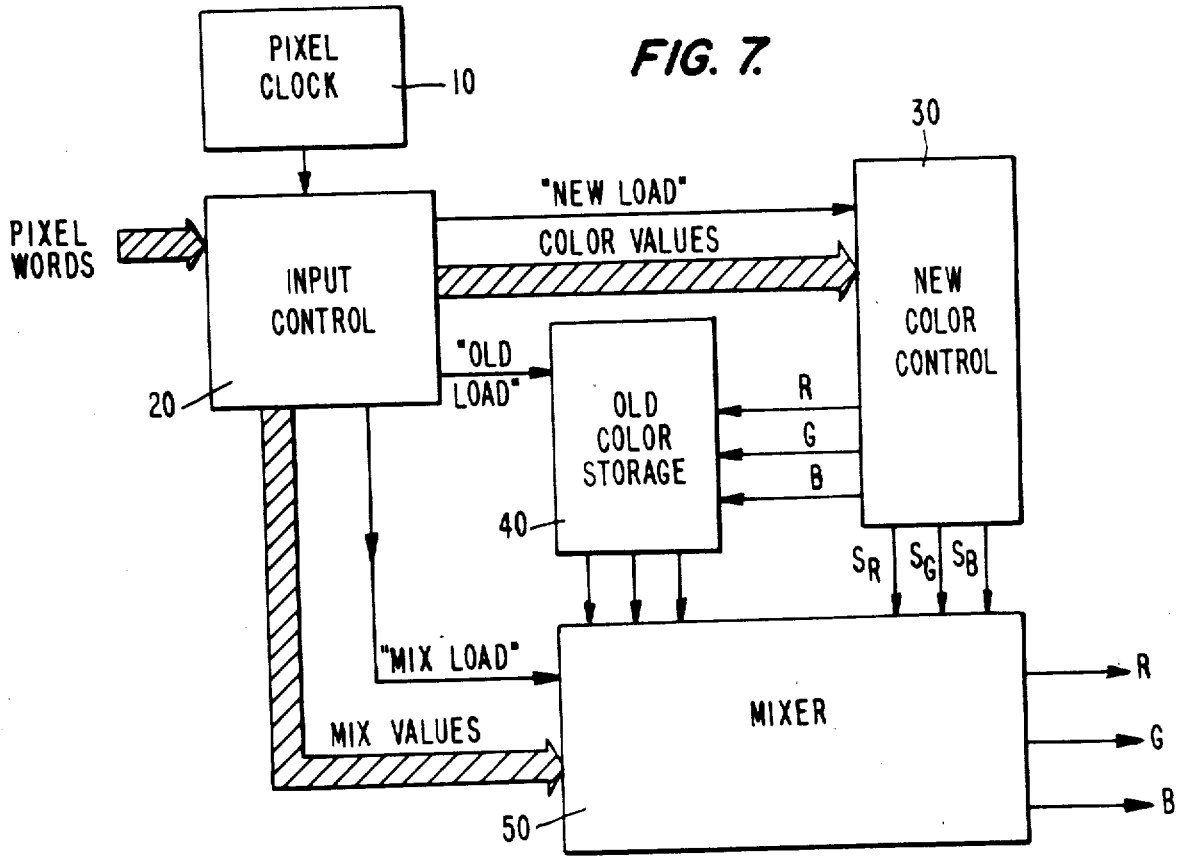
FIG. 7 shows a block diagram of display-control means in accordance with a first embodiment.

With reference to FIG. 7, the control input circuit 20 of the video generator 16 controls the other three blocks: new-color control 30, old-color storage 40 and mixer 50. The new-color control circuit 30 is responsible for decoding the requested color number into the proper red, blue, and green components and producing suitable video signals. The old-color storage unit 40 produces appropriate video signals that correspond to the "old" color value. Upon command from the input control circuit 20, the old-color storage unit 40 will copy the current "new" color value making it the "old" color value. The mix circuit 50 is responsible for properly mixing the "old" video and the "new" video to produce the desired final video output.

Figure 8:
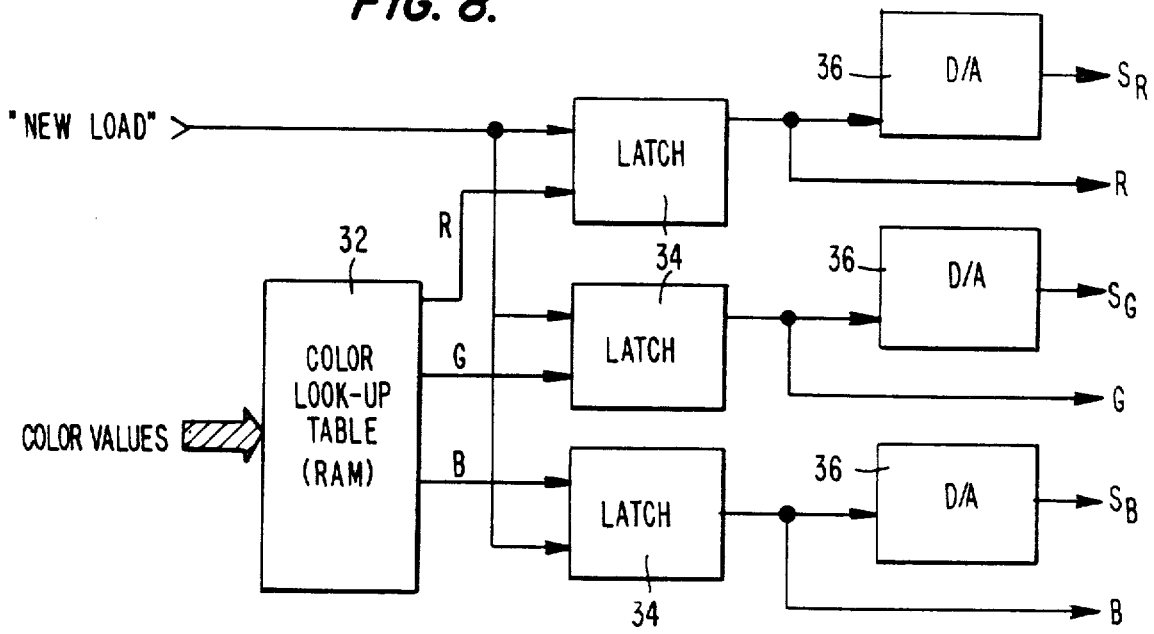
FIG. 8 shows details of the new color control shown in FIG. 7.

FIG. 8 shows details of the new color control circuit 30. A pixel color value indicating a look-up table location is applied to the address input of a RAM color look-up memory 32. The memory then provides a set of red, blue, and green intensity values which were stored at that address location. These intensity values, R, G, B are latched, respectively, by a set of three latches 34 in response to a "New Load" signal produced by input control circuit 20. The outputs of the latches are connected to digital-to-analog (D/A) converters 36 which produce analog intensity signals for each color. These analog intensity signals are then sent to the mixing circuit 50. The outputs of the latches 34 determine the current "new" color in use and also provide the intensity values to the old color storage circuit 40.

Figure 9:
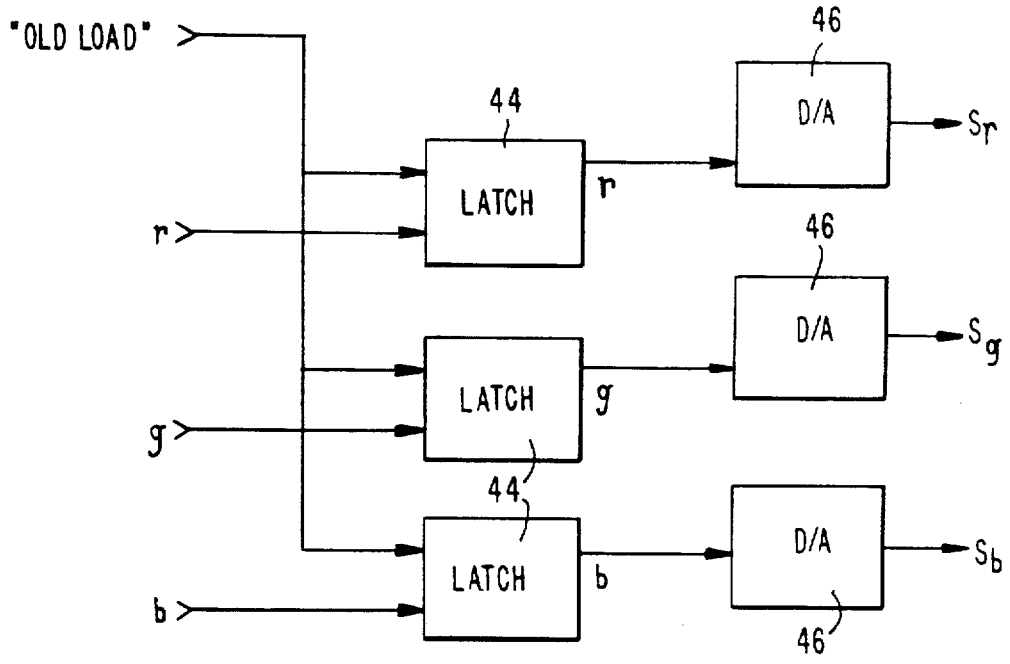
FIG. 9 shows details of the old color value storage means shown in FIG. 7.

FIG. 9 shows the old-color storage circuit 40. It is identical to the new-color control circuit 30 except that it has no color look-up RAM memory 32. When the signal "Old Load" is output by the input control circuit 20, the old-color latch latches 44 are clocked to copy the current color values as "old" color values. While this is happening, the latches 34 in the new-color control circuit 30 are latching different "new" intensity values. The D/A converters 46 convert the digital "old" intensity values which appear as the outputs of the old values latches 44 into analog intensity signals to be sent to the mixing circuit.

Figure 10:
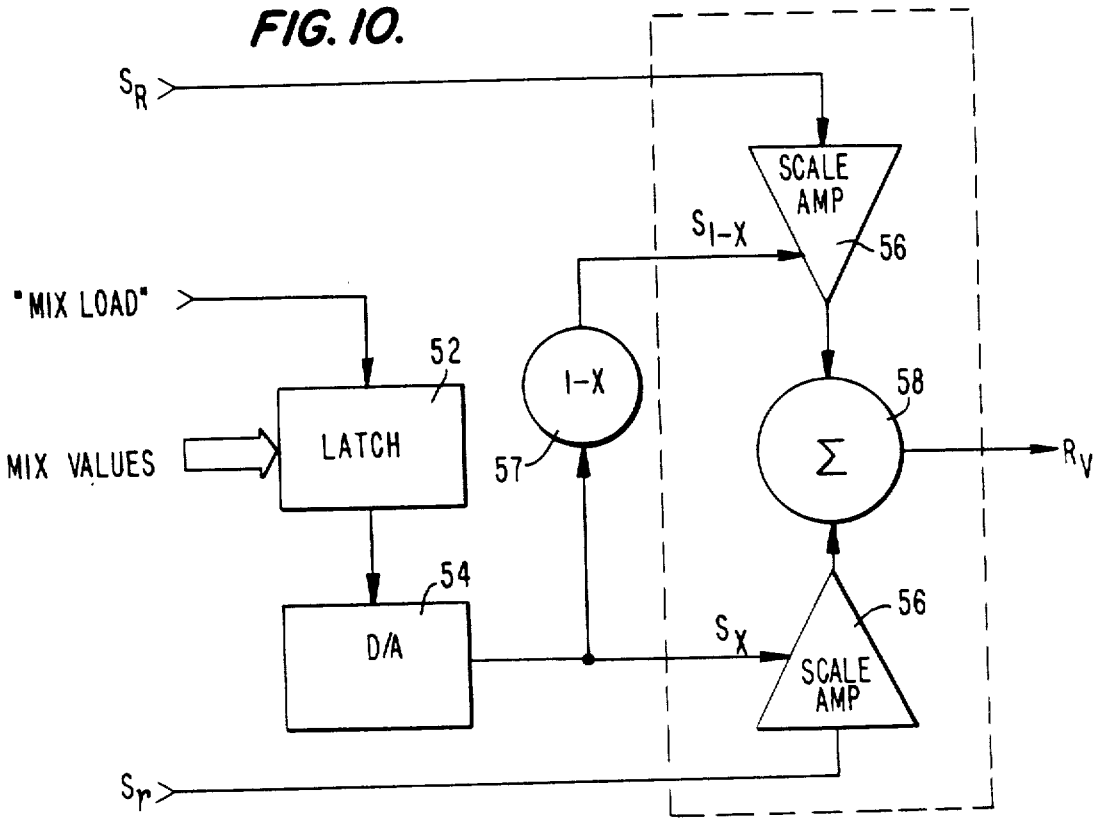
FIG. 10 shows detail of an embodiment of the mixer shown in FIG. 7.

One embodiment of the mix circuit 50 is shown in FIG. 10. The mix value is latched 52 by a "Mix Load" signal from the input control circuit 20, and applied to a D/A converter 54. The analog voltage output of the D/A converter 54 controls scaling amplifiers 56. One amplifier is driven directly by the D/A, the other is driven through a conditioning circuit 57, denoted as "1-X", which creates a voltage representing the reciprocal of the gain produced by the D/A voltage. The factors are then summed as follows: $N\% \times \text{old} + (100\% - N\%) \times \text{new}$. In this embodiment the "old" and "new" intensity signals for one of the video primary colors are applied to a pair of amplifiers with controllable gain to scale the intensity signals in accordance with a pixel mix value in the relevant pixel word. These scaled signals are then added at the summing junction 58 to provide the final video signal output.

Alternatively, the mix data can be also applied to a RAM look-up table to create a second digital code that is then passed through a second D/A converter to create the reciprocal control voltage. Also, FET transistors could be used as voltage controllable resistances to control the scaling amplifiers, or multiplying D/A's could be used in the new color control and color storage units to scale the intensity signals. The new color control and color storage units could alternatively be adapted to provide digital video primary color values which would then be digitally scaled by ROM lookup tables that are addressed by the video primary color value and the respective mix control value. The digitally scaled outputs of the ROMs for old and new color values would then be added and D/A converted to produce the final video signal output.

Figure 11:
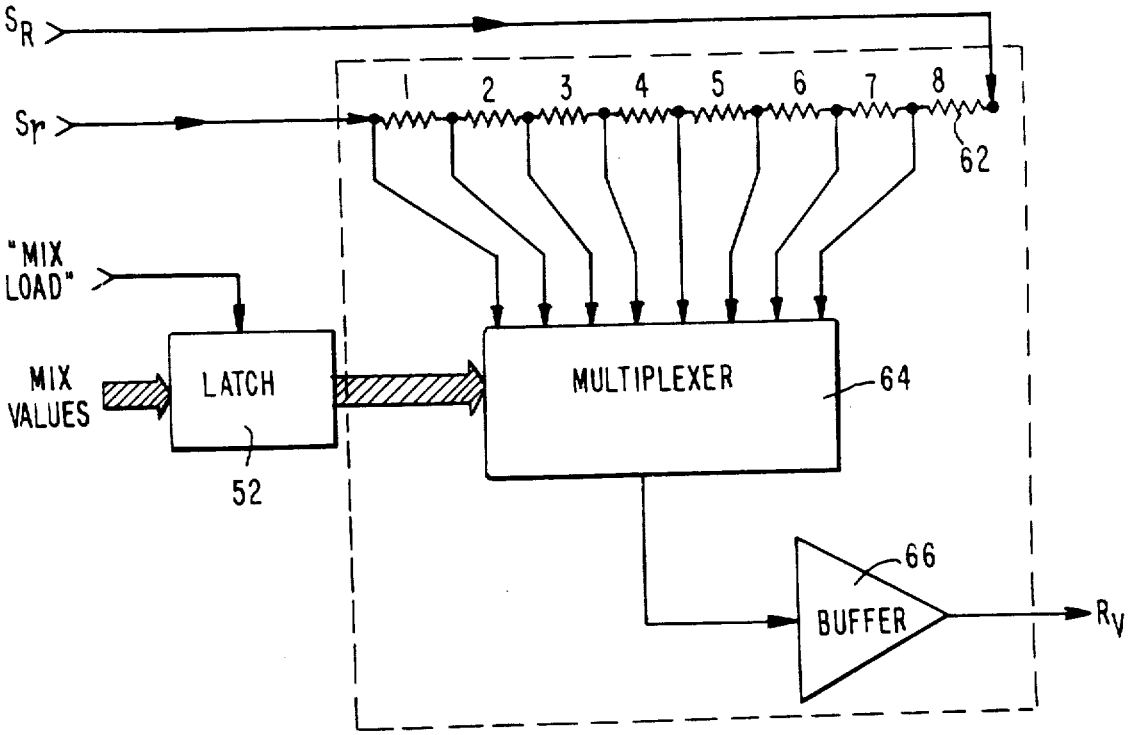
FIG. 11 shows details of an alternative embodiment of the mixer shown in FIG. 7.

A very simple alternative embodiment of the scaling and summing circuit for one for the video primary colors is shown in FIG. 11. A resistor divider chain 62 is established between the new and old intensity signals. An analog multiplexer 64 is used to select the desired tap of the resistor divider. The analog multiplexer provides eight switch positions for selecting one of eight possible scale factors for output through a buffer amplifier 66. In both FIGS. 10 and 11 the dotted line indicates a portion of the circuit which must be implemented three times, once for each video primary color: red R, green G, and blue B.

Figure 12:
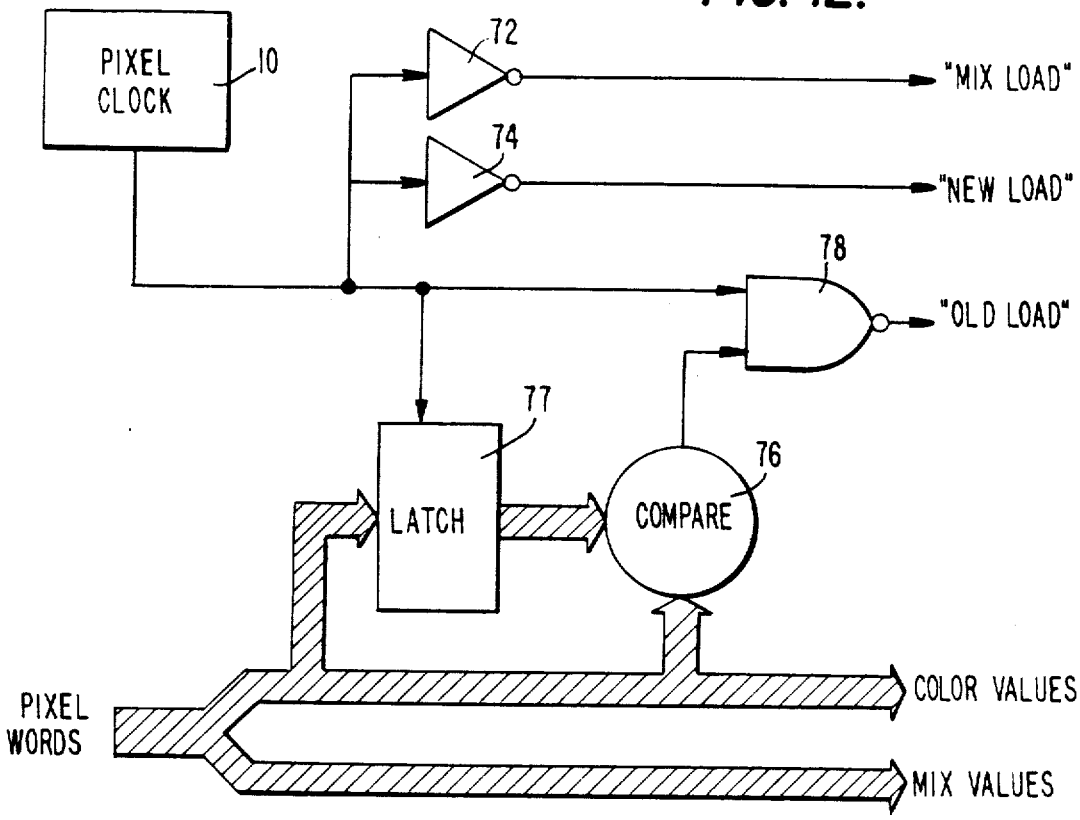
FIG. 12 shows input control means in accordance with the first embodiment.

FIG. 12 shows input control circuit 20 for use with the bit-divide format. The pixel word is split into its color and mix parts. The mix value goes to the mix circuit 50 and the color value goes to the new-color control circuit 30. The "Mix Load" and "New Load" signals are produced by inverters 72, 74, respectively, from the pixel clock pulse. A comparator 76 determines whether to update the "old" color value or retain the current "old" color. The determination is based solely on whether the incoming color value is different from the previous color value, the previous color value is retained in a latch 77 and compared to the incoming color value. If the two are not equal, the pixel clock produces a negative-going "Old Load" signal from the NAND gate 78 and the "old" value stored in old color storage 40 is replaced.

A Pixel-Delay Embodiment

Bit-divide apparatus allocates a certain number of bits in each pixel word for color and mix information. In contrast to that apparatus, pixel delay apparatus interprets each pixel word as either a color value or a mix value. Thus, if 8 bits are used in each pixel word, values in the range of 0 through 255 are available for use as mixing and color values. The second embodiment of the present invention determines whether the pixel word is indicating color or mix by the numerical range of the value in the word. The range can be divided at any value. For example, 0–223 for color and 224–255 for mix values. For fewer colors but more detailed mix information, 0–127 for color values and 128–255 for mix values.

In the examples that follow, 0–127 are color values and 128–255 are mix values. To get the "old" mix proportion from a pixel word containing the mix value "X", subtract 128 then divide by 128: "old" color mix=(X−128)/128. The result is assumed to be the mix proportion of the "old" color, thus the mix proportion of the "new" color mix=(256−x)/128. Thus to indicate only "new" color to be displayed, the value would be "128". Likewise a value of 135 indicates that a contribution of 7/128, that is, (135−128)=7, comes from the "old" color and 121/128, that is, (265−135)/128, comes from the "new" color.

To indicate that a pixel should be displayed with a pure, unmixed color, the number of the color is written into the corresponding pixel word, the next color value is written into the next pixel word and so on, as is done in traditional non-smoothed pixel system; therefore, graphic programs designed to work on traditional non-smoothed hardware will work as designed in apparatus in accordance with the present invention. In other words, an older graphics which were input without the smoothing encoding apparatus, will draw diagonals in the conventional pixel-by-pixel staircase manner. However, since smoothing operates on a pixel-by-pixel basis, smooth and non-smooth image inputs can be used together in a composite scene. Even such complicated images as digitized photographs can be shown alone, used as background, or combined with smooth graphics in accordance with the present invention.

To indicate that a mixing should be performed, apparatus in accordance with a pixel-delay embodiment of the present invention stores a mix value in the corresponding pixel word and the "new" color value in the preceding pixel word. Thus, the given pixel word preceding each pixel word containing a mix value provides no color value for the pixel corresponding to the given preceding pixel word. The color value supplied for that pixel is the old color unmixed with the color indicated in that given preceding pixel word.

Tables 5 through 8 show pixel-delay encoding for the edges shown in FIGS. 2 through 5. The first row of numbers shows the color value of the pixels on a blank screen: all pixel color values are "0" indicating a constant color, color #0. In this case it is the background color. The second row contains the values in the same pixel words after an image containing an object of color #1 is input.

TABLE 5

| | Pixel-Delay - Leading Edge Image | | | | | | | | |
|---|---|---|---|---|---|---|---|---|---|
| Pixel | A | B | C | D | E | F | G | H | I |
| Before Image | 0 | 0 | 0 | 0 | 0 | 0 | 0 | 0 | 0 |
| After Image | 0 | 1 | 243 | 218 | 192 | 166 | 141 | 1 | 1 |

With reference first to the "leading edge" of FIG. 2 and Table 5, pixel A is unaffected by the edge but pixel word B is given a value of "1" which indicates a color change in the row. Pixel word C has a value of "243" which is a mix value since it is greater than 128. Since pixel word B is a color value followed by a mix value, the color value in pixel word B is not the color value of pixel B, but is part of the code for pixel word "C". Therefore, pixel B is colored with 100% of the "old" color #0 and determination of the intensity signals for the display of pixel B must be delayed until the pixel word for pixel C has been examined, hence the name "pixel-delay".

The pixel word for pixel C is a mix value, 243, which implies 115/128 (243−128=115) of the "old" color and 13/128 of the "new" color. The "old" color is color #0 and the "new" color is color #1 and, indeed, pixel C appears to be about one-tenth covered by color #1. Pixel word D also has a mix value 218. There has been no further color information, therefore, the "old" color is #0 and the "new" color is #1. The mix value 218 in pixel word D indicates 90/128 "old" mixed with 38/128 "new". Pixel D also appears to be about three-tenths covered by the "new" color.

This process is repeated for each pixel up to pixel H, the first pixel that is totally covered by the object. The value in the pixel word for H is simply "1" indicating color #1. The intensity signals are not determined until the subsequent pixel word is checked but since "1" in pixel word I is a color value, pixel H is displayed as 100% color #1. Likewise, pixels I, J, and K are displayed as 100% color #1.

TABLE 6

| | Pixel-Delay - Trailing Edge Image | | | | | | | | | | |
|---|---|---|---|---|---|---|---|---|---|---|---|
| Pixel | L | M | N | O | P | Q | R | S | T | U | V |
| Before Image | 0 | 0 | 0 | 0 | 0 | 0 | 0 | 0 | 0 | 0 | 0 |
| After Image | 1 | 1 | 1 | 1 | 0 | 240 | 208 | 176 | 144 | 0 | 0 |

With reference to the trailing edge of FIG. 3 and Table 6, after the image is input, pixel words L through O have a value of "1" indicating that the entire area of pixels L through O is filled with color #1. In FIG. 3, pixel Q is the first pixel which is affected by the edge of the object. Therefore, pixel word P is given the value of the new color, #0, while pixel word Q contains a mix value, 240 indicating the proportions of 112/128 color 190 1 and 16/128 color #0. Pixel "P" is 100% covered by color 1901, not color #0, but since pixel word P indicated color 1900 and was followed by a mix value in pixel word Q, pixel P will be properly displayed as the "old" color #1. Pixel words R, S, and T provide other mix values to complete the transition to color #0. Pixel words U, V and beyond retain the color value "0" indicating a uniform display of color #0, the color actually displayed in those pixels.

TABLE 7

| | Pixel-Delay - Steep Leading Edge Image | | | | | | | |
|---|---|---|---|---|---|---|---|---|
| Pixel | AA | BB | CC | DD | EE | FF | GG | HH |
| Before Image | 0 | 0 | 0 | 0 | 0 | 0 | 0 | 0 |
| After Image | 0 | 1 | 213 | 1 | 0 | 1 | 179 | 1 |

With reference next to the steep leading edge of FIG. 4 and Table 7, it is apparent that pixels AA and EE are unaffected by the edge. Pixels DD and HH are within the interior of the object and simply receive the object color #1. Pixels BB and CC define a one-pixel transition, and pixels FF and GG define a similar transition on the next scan line. Pixel word BB is given the value of "1" because of the coming color change in pixel "CC", and pixel word CC contains the mix value for pixel CC. Since pixel word BB has a color value and is followed by a mix value in pixel word CC pixel BB is properly displayed as the "old" color, #0. Thus the display along the upper scan line is: AA is color #0, BB is color #0, CC is a mix of color #0 and color #1, and DD is color #1. The second scan line is similar with the exception that the mix proportion in HH is different from the mix proportion in CC reflecting the slight change in edge placement from one scan line to the next.

The corresponding trailing edge is shown in FIG. 5 and the pixel word values therefor listed in Table 8.

TABLE 8

| | Pixel-Delay - Steep Trailing Edge Image | | | | | | | |
|---|---|---|---|---|---|---|---|---|
| Pixel | L | LL | MM | NN | O | OO | PP | QQ |
| Before Image | 0 | 0 | 0 | 0 | 0 | 0 | 0 | 0 |
| After Image | 1 | 0 | 205 | 0 | 1 | 0 | 230 | 0 |

Figure 13:
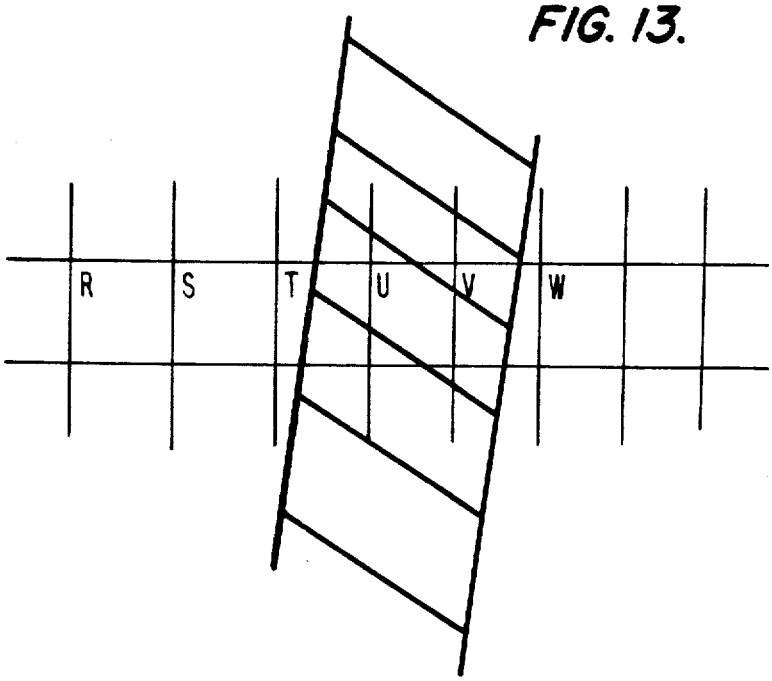
FIG. 13 shows a thin-line on a pixel-mapped screen.

In FIG. 13 a line approximately 2 pixels wide is superimposed on the pixels in a scan line. Table 9 contains the resulting pixel word values:

TABLE 9

| | Pixel-Delay - Thin Line Image | | | | | |
|---|---|---|---|---|---|---|
| Pixel | R | S | T | U | V | W |
| Before Line | 0 | 0 | 0 | 0 | 0 | 0 |
| After Line | 0 | 1 | 153 | 0 | 237 | 0 |

As before, the pixels all initially have the value "0", the background color #0. After the line is input, pixel word R is unaffected, pixel word S is given the value "1" to indicate a change to color #1 and pixel word T contains the mixing value for mixing color #0 and color #1 in pixel T. Since the color value in S was followed by a mixing value in T, S is displayed at the "old" color #0. Pixel word U contains a color value #0 indicating a change back to the background color. At pixel U, 0 becomes the new color and #1 becomes the "old" color. Looking ahead to pixel word V, we see a mixing value and, therefore, know that the color value in pixel word U is not to be displayed in pixel U but rather the "old" color #1. Pixel W contains the color value for the background color. The resulting display is: pixel R is color 190 0, pixel S is color #0, pixel T is a mix of colors #0 and #1, pixel U is color #1, pixel V is a mix of colors #1 and #0, pixel W is color #0.

As mentioned before, pixel-delay apparatus requires that graphic lines be more than one pixel wide in order to be properly smoothed. This is true in normal pixel systems, as well. FIG. 13 illustrates a line pattern of the minimum width which produces the smoothed two-edged "color, mix, color, mix" pattern. If smoothing is not necessary, as is the case for horizontal and vertical lines, the lines can be one-pixel wide. If one-pixel wide lines are not vertical or horizontal, however, noticeably aliased, jagged edges on the line images will be produced.

Figure 14:
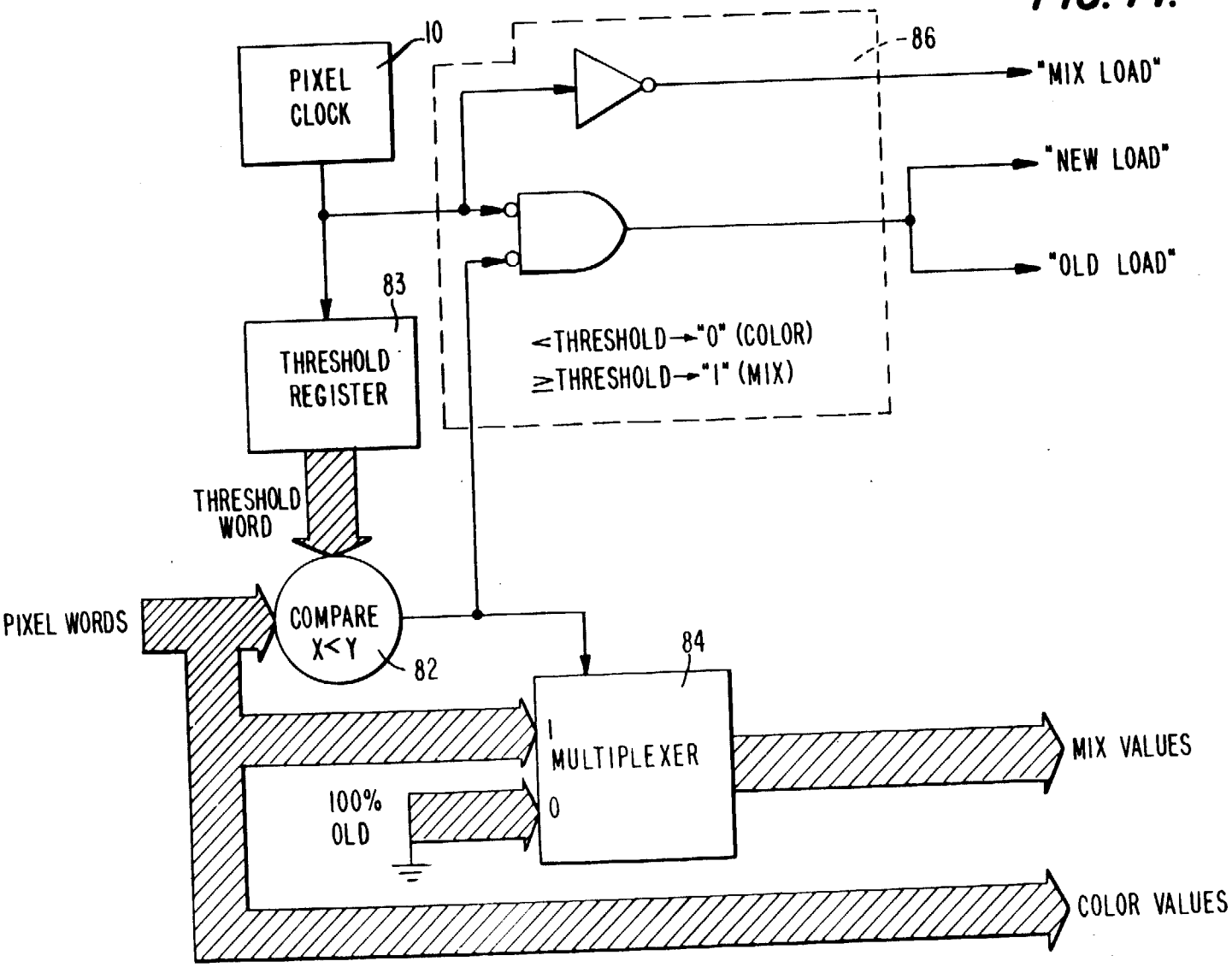
FIG. 14 shows input control means in accordance with the second embodiment.

Except for details of the input control circuitry shown in FIG. 14, pixel-delay apparatus is identical with the bit-divide apparatus described above. In the embodiment shown in FIG. 14 a pixel word is first input to a comparator 82 to determine if the value of the incoming pixel word is greater than a predetermined threshold value stored in register 83. If it is above the threshold value, the pixel word is a mixing value. The output of the comparator is "1" if the value is a mix value, that is, if it is equal to or above the threshold, and is "0" if the value is less than the threshold and therefore is a color value. This threshold can be changed to allow a different trade-off between the number of colors and the number of mix values. It can even be changed under software control through the use of a threshhold register, so long as the number allocation that was used in encoding the pixels is compatible with the threshhold value and mix calculation used in decoding them.

The comparator 82 controls a 2-to-1 multiplexer 84 which supplies mix values to control the mixer 50. When a pixel word contains color values, a constant mix value, indicating 100% usage of the "old" color, is selected and is supplied to the mix data lines. The "Mix Load" signal is clocked in every cycle of the pixel clock 10, as described above. A mix value is thus supplied for every pixel although mix values are only stored in pixel words corresponding to pixels containing edges.

The comparator also controls the timing logic 86 for the "Old Load" and "New Load" signals. When the input data is a color value, both the "New Load" and "Old Load" signals are clocked together and the "old color" and "new color" latches act as shift-registers. All pixel words are supplied to these latches in this second embodiment, but the "Old Load" signal that initiate their conversion into intensity signals for the display does not occur until the comparator detects color value. Color and mix values are processed in substantially the same way for both embodiments thereafter.

A Wide-Pixel Embodiment

Multiple mix values can be stored in a pixel word if a sufficient number of bits are allocated for each pixel. The mix operation for a given pixel requires only a single value, whereas the color displayed is a combination red, green and blue intensities. In a third embodiment of the present invention each pixel word contains either one color value represented by a set of a video primary intensity values or respective mix values for multiple side-by-side sub-pixel areas. The mix values are encoded using the pixel-delay format.

Figure 15:
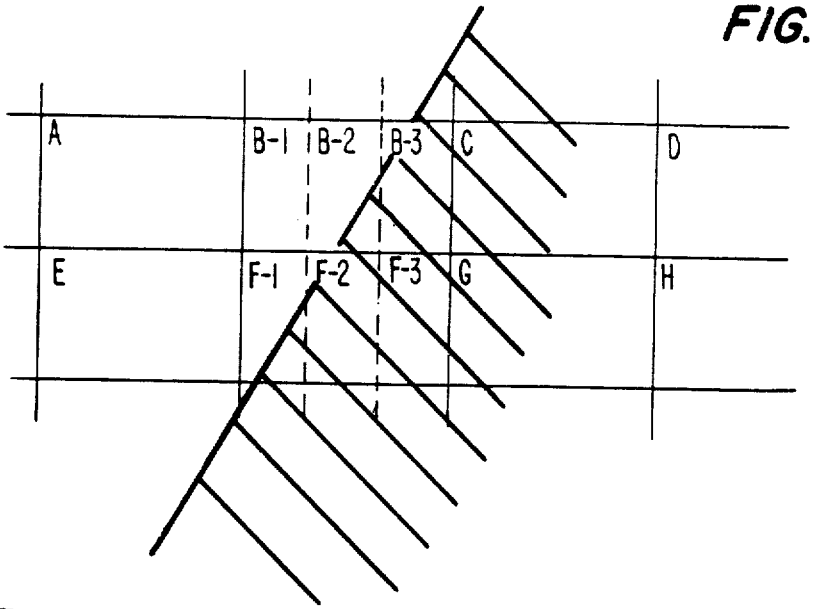
FIG. 15 shows a leading edge on a wide-pixel format screen.

For example, in FIG. 15, the object edge intersects pixel B and pixel F. As in the pixel-delay system, the new color introduced by the object would be placed in pixel words corresponding to those pixels in the same scan line that directly precede the pixels which are intersected by the edge, pixel words corresponding to pixels "A" and "E", respectively. In the wide-pixel system, unlike the simple pixel-delay system, three mix values are stored in subdivisions of the pixel words allocated for pixels "B" and "F", respectively, representing three sequential sub-areas of each pixel, B-1, B-2, B-3, and F-1 F-2, F-3, as seen in tables 10 and 11. Here 5-bit mix values range from 0=100% old to 31=100% new color.

TABLE 10

| | Wide-Pixel - Leading Edge Image | | | | | |
|---|---|---|---|---|---|---|
| Pixel | A | B-1 | B-2 | B-3 | C | D |
| Before Image | 0 | 0 | 0 | 0 | 0 | 0 |
| After Image | 1 | 0 | 9 | 28 | 1 | 1 |

TABLE 11

| | Wide-Pixel - Leading Edge Image | | | | | |
|---|---|---|---|---|---|---|
| Pixel | E | F-1 | F-2 | F-3 | G | H |
| Before | 0 | 0 | 0 | 0 | 0 | 0 |

TABLE 11-continued

| Pixel | Wide-Pixel - Leading Edge Image E | F-1 | F-2 | F-3 | G | H |
|---|---|---|---|---|---|---|
| Image After Image | 1 | 10 | 30 | 31 | 1 | 1 |

The edge shown in FIG. 15 does not affect B-1 (100% old color), partially affects B-2 (70% old color) and dominates B-3 (10% old color). Since the B and F pixels are subdivided, the edge can be placed more accurately and the apparent resolution of the image is higher. The image resolution is coarser in the regions where no edges occur, but there is no need for greater resolution where there is uniform color.

With this locally increased resolution the memory capacity required for a given apparent resolution is reduced. For instance, a system can be designed with pixels three times the normal size to use ⅓ the memory of a simple pixel system, or can be designed with normal size pixels and use the small mix areas to produce a three-fold increase in horizontal resolution, or by compromise, reduce memory in half and still produce a 50% increase in apparent horizontal resolution. The trade-off, however is that the width of each pixel determines how close together adjacent objects can be placed and how small objects can be. The wide-pixel encoding allows very wide color range, but large, well-spaced solid color objects. If all the pixels are as small as the subdivided parts of these wide pixels the apparent resolution will be the same, but the objects could also be small, since actual as well as apparent image resolution would be increased. On the other hand, fewer colors would be available if memory capacity were held constant.

An embodiment of the present invention providing wide-pixel format encoding requires a modification of the input control means 20 different from that which was used with the pixel-delay format in the second embodiment in that the clock rate is increased to a multiple of the pixel rate to permit sub-pixel mixing. Also, when the wide-pixel word contains at least three times the number of bits needed to indicate color values, these bits may be used to store video primary intensities in the pixel memory to identify the color without reference to the look up table 32 shown in FIG. 8.

Figure 16:
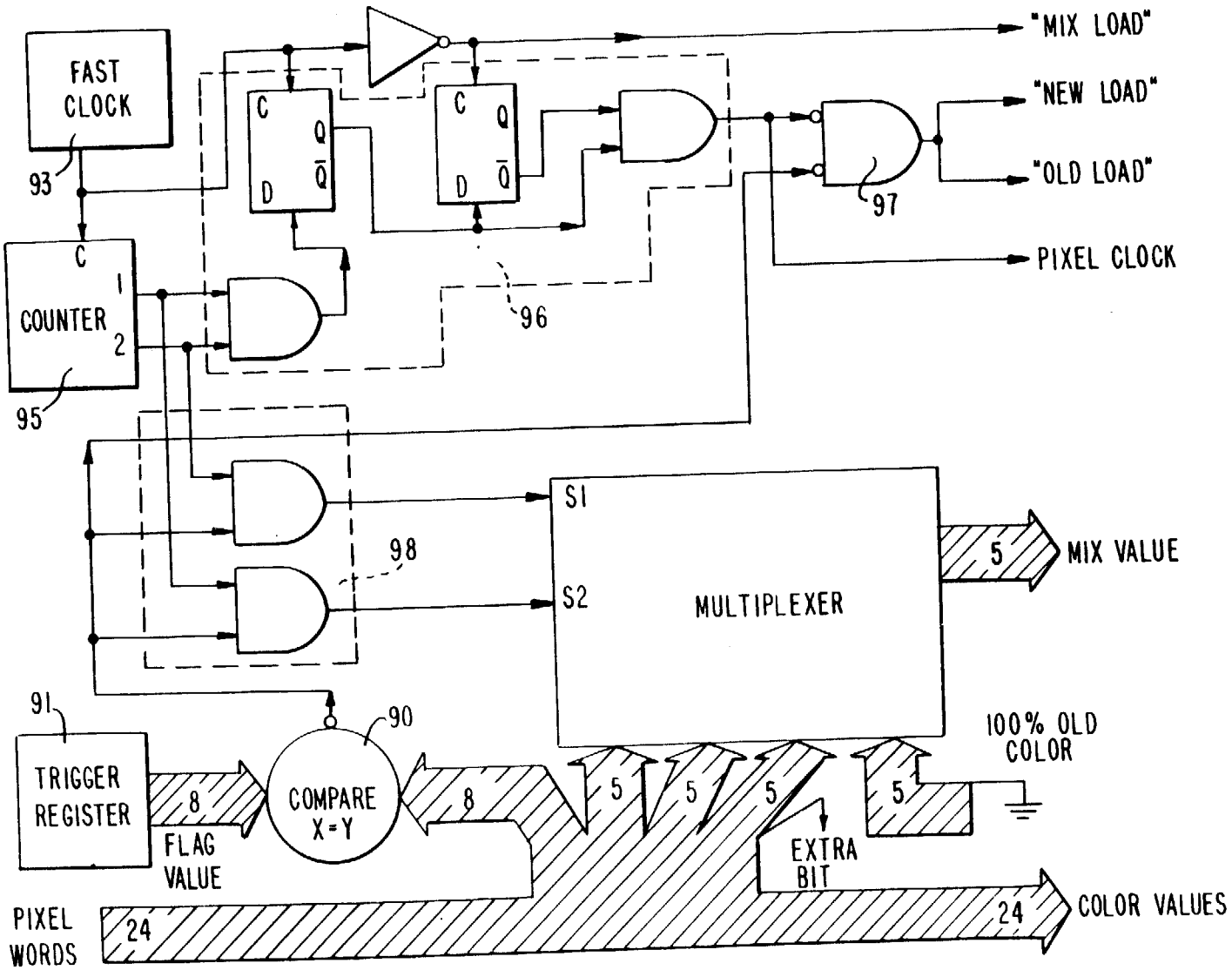
FIG. 16 shows input control means in accordance with the third embodiment.

The wide-pixel word used in the embodiment of the input control means 20 shown in FIG. 16 is 24 bits long. Each 8 bit sub division of the pixel word specifies the intensity of the red, green and blue input, respectively. The most significant red intensity, however, is set as a "flag" intensity. This flag indicates that the pixel word contains mix values when it is set. A comparator 90 checks the value of the red section of the pixel word against a "flag value" stored in Register 91, and produces a signal when the flag is set. The remainder of that pixel word, 16 bits, is input to a multiplexer 92. When the bits in a pixel word contain mix values, the 16 bits of the blue and green sections of that pixel word contain three 5-bit mix values, each of which provides 32 possible mix shades for corresponding sub pixel areas. The least significant of the 16 bits is not used.

The pulse produced by the fast clock 93 shown in FIG. 16 is divided by three by the combination of a counter 95 and a logic circuit 96 comprising two flip-flops and two AND gates. This slower pixel-rate clock is gated by the output of the comparator 90 through a final AND gate 97 to suppress the "New Load" and "Old Load" signals during the transfer of pixel words containing mix values. During the input of mix values, the "mix cycle", the counter 95 counts in a "1, 2, 3, 1, 2 . . . " cycle, to control a four-to-one multiplexer 92 that sequentially provides each of the three mix values to the mixer 50. This fast clock pulse is also processed by an inverter 94 to provide the "Mix Load" signal just as it was in the other embodiments. Mix values are loaded at this faster rate to allow sub-pixel mixing to occur. When there is no mixing, the rate of mix loading remains the same as a matter of convenience.

During a color cycle, the output of sub-pixel select logic 98 is gated by the output of comparator 90 which forces the multiplexer 92 to select input #0. Input #0 is the value which provides a 100% "mix" of the old-color. This is similar to the operation of the pixel-delay control system.

Other wide-pixel formats are also possible. For instance, an initial flag bit could be added to indicate whether the next word contains mix or color values. Then the next 24 bits could contain 3 sub-pixel mix values from 0 to 255, rather than only 0 to 31 or the 24 bits could be interpreted as four 6-bit values for smaller sub-pixels without requiring increased storage space in memory. Likewise 19 bits could be used for each pixel yielding one flag bit, and either 6 bits each for red, green and blue in color values or three 6-bit mix values. For more compact storage a variable-length pixel word might be used, either 9 or 25 bits long, depending on how the flag bit is set, as is well-known in the art. Thus, one color value in the range from 0 to 255 would appear in some words and others would have three mix values, each in the range of 0 to 255.

The richness of color and range of shading available from apparatus providing the wide-pixel format is well-suited to solid-modeling applications. In drafting and line-drawing computer graphics applications, the smaller object size permitted by the simple pixel-delay format is more desirable. The bit-divide format provides smoothing for lines that are a single pixel wide, but a smaller range of mixing and color values. These formats can be made switch-selectable or software-selectable to allow users to choose the format that is best for a particular project.

Figure 17:
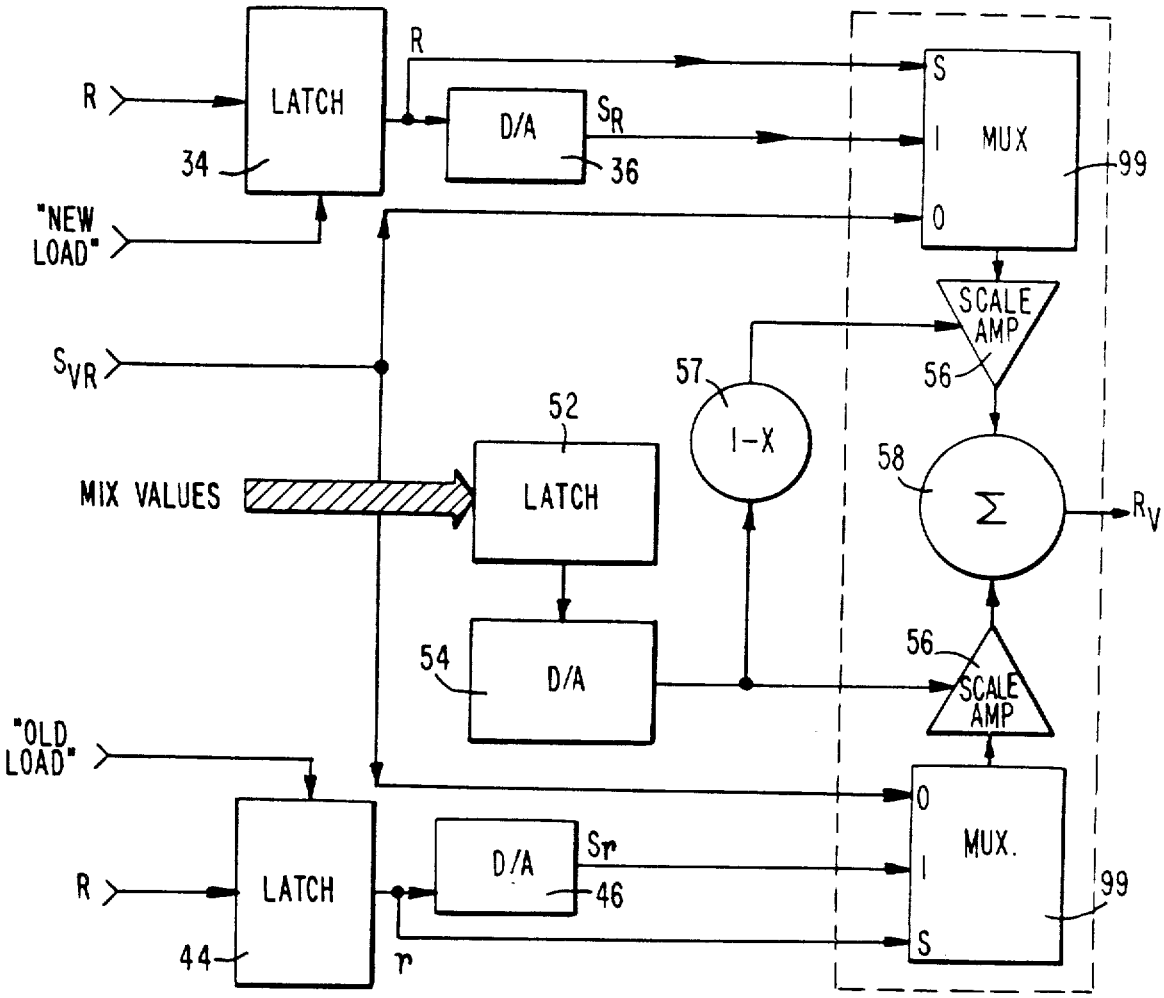
FIG. 17 shows an embodiment of the mixer shown in FIG. 7 for use with live video.

Smoothing in accordance with the present invention is also useful for the insertion of live video program material using the mix circuitry shown on FIG. 17. Two 2-to-1 multiplexers 99 have been inserted into the input path to the scaling amplifiers. The background color "0" is detected to the old color storage and new color control circuits. When the color value "0" is detected by the multiplexers, the live video is connected to the scale amplifier and the D/A output is disconnected. In this way, the intensity signals of the live video will be mixed with graphics material. The video will thus provide a background image for an object having edges that are smoothed in accordance with the present invention. The live video can, alternatively be assigned any color value or series of color values, and be used in the same manner as any other color. If more than one ive video source is desired, the 2-to-1 multiplexers can be changed to wider multiplexers, and the video signals can be selected at will. The edge smoothing of live video-to-live video edges assumes, of course, that the video sources are synchronized with each other and with the smoothing apparatus.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein. For example, the present invention has been discussed primarily with reference to the color of pixels in simple figure/ground images, but it is not limited to such applications. Brightness values can also be encoded in accordance with the present invention.

I claim:

1. Apparatus for reducing aliasing of edges in images displayed on a pixel-based display device, said apparatus comprising:

image storage means for storing image data words, each representing image information for a corresponding pixel of an image, respectively;

display-encoding means for encoding display values representing colors or shades corresponding to components of said image, said display values being stored in said image storage means as part of said image data words, said display values each comprising a plurality of data bits;

mix-encoding means for determining mix values, each comprising a plurality of data bits, to be stored in said image storage means as part of the image data words corresponding to pixels containing edges between differently colored or shaded image components in said image, said mix-encoding means determining said mix values as a function of the relative area covered by the color or shade of each image component within the respective pixel; and image decoding means for decoding the image information provided by said image data words into signals to control said display device to reproduce said image whereby for each image data word containing a mix value the corresponding pixel displayed by the display device is determined from such mix value and two display values at least one of which is stored in said image storage means representing an image component color or shade adjacent to the edge corresponding to such mix value.

2. Apparatus for encoding images to reduce aliasing of edges in pixel-based images wherein each pixel in an image is represented by a respective image data word adapted for display by a display device using complementary decoding apparatus, said apparatus comprising:

display-value encoding means for encoding display values required by the display device to produce an image, said display values being represented in given multibit image data words corresponding to pixels in the image; and mix-encoding means for determining mix values represented in image data words corresponding to pixels containing edges between differently shaded or colored components of said image, said mix-encoding means determining mix values for respective pixels as a function of the relative area of the corresponding pixel covered by each image component.

3. Apparatus as claimed in claim 2 wherein said respective image data words each contain a flag bit for indicating whether said word contains a display value or a mix value.

4. Apparatus as claimed in claim 2 wherein said respective image data words each comprise a mix value and a display value.

5. In combinatiion with encoding apparatus claimed in claim 2, apparatus for decoding said image data words, said apparatus comprising:

means for distinguishing display values from mix values in said image data words;

means for determining first and second display values;

means for producing first and second display signals representing said first and second display values, respectively; and means for mixing said respective first and second display signals in a proportion indicated by said respective mix values so that the aliasing of the edge in a corresponding pixel is reduced when the image is displayed.

6. In combination with encoding apparatus claimed in claim 4, apparatus for decoding said image data words, said decoding apparatus comprising:

means for separating image data words into respective mix values and first display values;

means for determining a respective second display value; and means for combining said respective first and second display values in a proportion indicated by said respective mix value to produce a signal providing a display wherein aliasing of pixels containing edges is reduced.

7. In combination with encoding apparatus as claimed in claim 2, control means to determine old and new display values for each pixel containing an edge, said old display being determined by the previous adjacent pixel word that contains a display value and said new display value being determined by the subsequent adjacent pixel word that contains a display value.

8. Apparatus as claimed in claim 7 wherein said respective image data words corresponding to each of said pixels containing edges each comprise multiple mix values corresponding to respective subdivisions of the area of said corresponding pixels.

9. A combination as claimed in claim 7, further comprising:

means for combining the old and new display values for each pixel containing an edge in a proportion indicated by each of said respective mix values so that when the image is displayed, the aliasing of edges in pixels corresponding to pixel words containing said mix values is reduced.

10. Apparatus as claimed in claim 9 wherein said respective image data word corresponding to each of said pixels containing edges comprises multiple mix values corresponding to respective subdivisions of the area of said pixel.

11. An apparatus as recited in claims 1 or 2, wherein said display values represent different colors in the image to be displayed.

12. A method for reducing aliasing of edges between different display values representing different colors or shades in an image to be displayed in pixel-based displays comprising the steps of:

(1) determining a display value comprising a plurality of data bits for each pixel that does not contain an edge;

(2) storing said display value as a component of an image data word corresponding to such pixel;

(3) calculating a mix value comprising a plurality of data bits for each pixel containing an edge as a function of the relative area of such pixel covered by different colors or shades adjacent to such edge;

(4) storing said mix value as a component of an image data word corresponding to said pixel having said edge;

(5) determining a new display value for each pixel containing an edge; and (6) storing said new display value as a component of an image data word (7) controlling a pixel based display device to display said image in accordance with the display values determined in steps (1) and (5) and the mix values determined in step (3) wherein pixels of said image containing an edge are determined by combining display values with the corresponding new display values in a ratio determined by the corresponding mix values.

13. A method for reducing aliasing of edges between different display values representing different colors or shades in images displayed in pixel-based displays for which display values and mix values are encoded as image data words comprising the steps of:

(1) determining whether an image data word contains a mix value:

(2) determining first and second display values respectively for each side of an edge for each image data word containing a mix value;

(3) determining a display signal for each pixel corresponding to an image data word containing a mix value by combining said first and second display values in a ratio determined by said mix value; and (4) applying said display signal to a display device.

14. A method as claimed in claim 13, wherein said second display value is stored as a component of said image data word corresponding to said pixel having said edge.

15. A method as claimed in claim 13 wherein said second display value is stored as a component of the adjacent image data word that precedes said image data word corresponding to said pixel having said edge.

16. A method as claimed in claim 12 or claim 13 wherein a mix value for each of a plurality of subdivisions of said pixel containing an edge are calculated and stored as a component of said image data word corresponding to said pixel having said edge.

17. An apparatus for displaying an image in pixel form comprising means to determine display values representing colors or shades corresponding to image components of the image to be displayed, and to determine mix values corresponding to pixels in the image to be displayed which pixels contain an edge between different colored or shaded image components, said mix values being a function of the relative area covered by the color or shade of each image component within the corresponding pixel, a pixel-based display device, a means to generate a signal to control said pixel based display device to display said image wherein each pixel in the image displayed containing an edge is determined by combining the display values representing the colors or shades of image components adjacent to such edge in a ratio determined by the corresponding mix value.

* * * * *

UNITED STATES PATENT AND TRADEMARK OFFICE

CERTIFICATE OF CORRECTION

PATENT NO. : 4,704,605

DATED : November 3, 1987

INVENTOR(S) : Steven D. Edelson

It is certified that error appears in the above-identified patent and that said Letters Patent is hereby corrected as shown below:

Column 1, line 24, after "called" delete the comma.

Column 2, line 24, change "exch" to --each--.

Column 4, line 49, change "new" to --next--.

Column 5, line 66, change "numbers" to --number--.

Column 10, line 41, change "190 1" to --#1--.

Column 10, line 42, change "1901" to --#1--.

Column 10, line 43, change "1900" to --#0--.

Column 11, line 46, change "190 0" to --#0--.

Column 12, line 37, delete "a" second occurrence.

Column 14, line 62, change "ive" to --live--.

UNITED STATES PATENT AND TRADEMARK OFFICE

CERTIFICATE OF CORRECTION

PATENT NO. : 4,704,605

DATED : November 3, 1987

INVENTOR(S) : Steven D. Edelson

It is certified that error appears in the above-identified patent and that said Letters Patent is hereby corrected as shown below:

Column 16, line 6, change "combinatiion" to --combination--.

Column 16, line 37, after "display" insert --value--.

Signed and Sealed this

Fourteenth Day of June, 1988

*Attest:*

DONALD J. QUIGG

*Attesting Officer*

*Commissioner of Patents and Trademarks*